United States Patent [19]

Dickèr

[11] Patent Number: 4,620,990

[45] Date of Patent: Nov. 4, 1986

[54] METHOD OF IMPREGNATING WOOD

[76] Inventor: Paul-Erik Dickèr, Bergsgatan 16, S-561 31 Huskvarna, Sweden

[21] Appl. No.: 584,949

[22] PCT Filed: May 5, 1983

[86] PCT No.: PCT/SE83/00181

§ 371 Date: Jan. 4, 1984

§ 102(e) Date: Jan. 4, 1984

[87] PCT Pub. No.: WO83/03997

PCT Pub. Date: Nov. 24, 1983

[30] Foreign Application Priority Data

May 6, 1982 [SE] Sweden ..... 8202861

[51] Int. Cl.[4] ..... B05D 3/12

[52] U.S. Cl. ..... 427/291; 427/325; 427/440

[58] Field of Search ..... 427/291, 325, 440

[56] References Cited

U.S. PATENT DOCUMENTS

| | | | |
|---|---|---|---|
| 29,363 | 7/1860 | Dain | 427/291 |
| 1,018,624 | 2/1912 | Klossvary et al. | 427/291 |
| 1,936,439 | 11/1933 | Siever | 427/291 |
| 2,062,081 | 11/1936 | Zwingauger | 427/291 |
| 2,208,361 | 7/1940 | Eckert | 427/291 |

FOREIGN PATENT DOCUMENTS

| | | | |
|---|---|---|---|
| 822330 | 8/1955 | United Kingdom | 427/291 |

OTHER PUBLICATIONS

International Research Group for Wood Preservation Report, Document No. WP/3225 by Swedish State Institute for Wood Technology.

*Primary Examiner*—John D. Smith
*Assistant Examiner*—Janyce A. Bell
*Attorney, Agent, or Firm*—Lewis H. Eslinger

[57] ABSTRACT

A method of diffusion impregnation of wooden structures, which include long wooden objects, with a wood preservative, depots with the wood preservative being placed, in a way known per se, within the wood. The characteristic feature of the method is that in sections of the wooden object in which the moisture ratio of the wood is less than substantially 25 % depots with wood preservative dissolved in a hygroscopic liquid are placed and that in sections of the wooden object in which the moisture ratio of the wood is greater than substantially 25 % depots with wood preservative in solid phase are placed. The depots are placed at intermittent distances from each other along the wooden structure so that each long object is impregnated along the whole of its length and right through it.

11 Claims, 9 Drawing Figures

Figure 1:
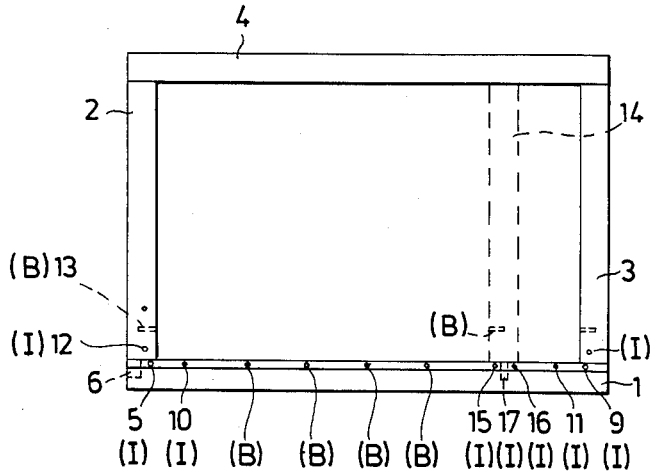

Fig. 4
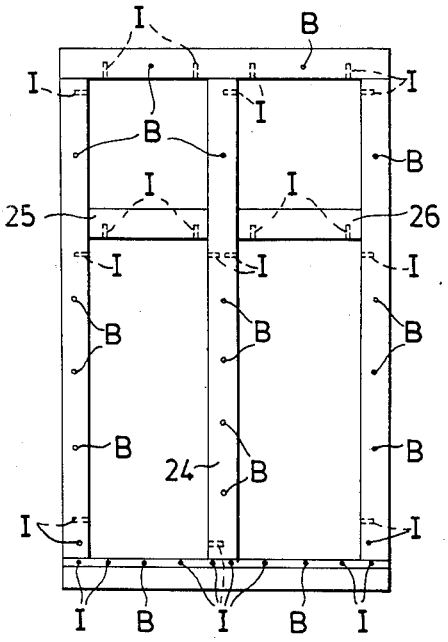
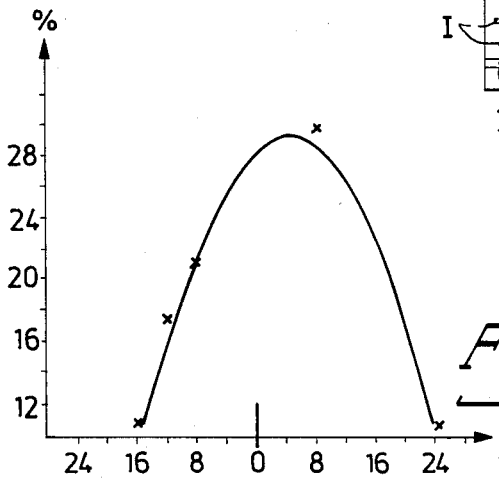
Fig. 5
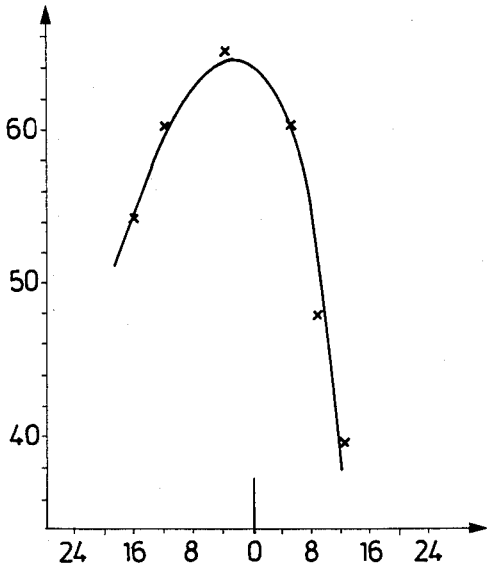
Fig. 6

METHOD OF IMPREGNATING WOOD

The present invention refers to a method of impregnating wooden structures which consist of long wooden objects, such as for example window-frames, window-casements, window-posts, door-frames, joists, cappings, sills etc., with a wood preservative, depots or reservoirs of the wood preservative being placed within the wood in a way known per se.

The purpose of the wood preservative is to protect the wood against biological destruction. Diffusion impregnation (also called osmotic impregnation) implies that the wood preservative diffuses into the moist wood. Diffusion impregnation is generally carried out by applying a water soluble wood preservative in the form of a paste or concentrated solution to be surface of raw, undried timber. The preservative then diffuses into the moist wood. By raw, undried timber is meant wood the moisture ratio of which exceeds about 25%. The moisture ratio is defined as the ratio of the mass of water in moist wood to the mass of the dried wood.

The British patent specification No. 912 381 describes diffusion impregnation of the type mentioned in the introduction. However, the method is suitable only for wood which is subjected to very moist conditions, for example wood in boats, quays, wooden structures buried in earth etc.

The Swedish patent specification No. 7810771-1 also describes a method of diffusion impregnation of the type described in the introduction. The wood preservative is in the form of a fused body of boron oxide. This prior method is suitable for impregnating wood the moist ratio of which is greater than about 25%. In wood the moisture ratio of which is less than about 25% the wood preservative spreads only to a very small extent. Thus it is not possible, with a reasonable number of depots per unit of length, to impregnate a piece of wood the moisture ratio of which is less than about 25%. The Swedish patent application No. 7803250 describes a method of impregnation of the type described in the introduction. The wood preservative is dissolved in a water-expellent liquid, usually an organic solvent. The water-expellent liquid expels free water and water bound in the wood so that the moisture ratio of the wood becomes a minimum of 21% (or more), which is a value that prevents the growth of fungi. The method is suitable for use in wood the moisture ratio of which is less than about 25%. In wood the moisture ratio of which exceeds about 25% this prior method does not work. Nor can the method be used for impregnating long pieces of wood in which the moisture ratio varies along the length of the wood piece. In a zone in which the moisture ratio of such a wood piece exceeds about 25% the water is not expelled and the remaining water further prevents the spreading of the wood preservative used along the length of the wood piece.

In the case of constructions of the type mentioned in the introduction the moisture ratio varies heavily along the long wooden object. The moisture ratio in the area of an end surface of the wooden object exceeds 30% while further away from the end surface it may be less than 20% and again further away possess moisture ratios which provide optimum moisture conditions of establishing fungus or insect attack. Accordingly, none of the methods described above is suitable for the impregnation of a wood piece of such a nature. Either the impregnation is not able to penetrate into the relatively dry wood which will thus remain untreated or the relatively dry wood may be treated while the relatively moist wood remains untreated. In the method according to the said Swedish patent application also the relatively dry sections of the wood piece may theoretically be impregnated if one assumes that the depots of the wood preservative are placed closely adjacent each other. In practice this would mean that the depots would have to be placed at a distance of the magnitude of 1 to 2 cm from each other so that the whole of the dry volume of wood can be impregnated. However, this is non-realistic since the wood piece will be perforated by bores. If the distance between such depots is increased no such impregnation of the intermediate relatively dry sections takes place or such sections will be impregnated only after a very long time, of the magnitude of several years.

According to another prior method of impregnation, which cannot be characterized as a diffusion impregnation, the wood preservative is injected under high pressure into the wood. When such injection takes plate in wood which is affected by fungus, there is a risk that the wood preservative escapes from these affected areas by spurting out from the wood. Accordingly, the wood preservative will not spread further to the sound wood which surrounds the affected zones.

The present invention aims at achieving diffusion impregnation of long wooden objects along the whole of their length, also in those sections where the moisture ratio is lower than substantially 25% and with the utilization of a reasonable number of depots per unit of length. In the wood treated by the method of the invention a retarding dose against the growth of fungus is achieved within a short period, of the magnitude of about 2 to 3 months, within a considerable range of spreading from the depot.

The characteristic features of the invention are that in sections of the wooden object in which the moisture ratio of the wood is less than substantially about 25% depots or reservoirs of wood preservative dissolved in a hygroscopic liquid are placed, and that in sections of the wooden object in which the moisture ratio of the wood in greater than substantially about 25% depots of wood preservative in solid phase are placed and that the depots are placed at intermittent distances from each other along the wooden structure so that each long wooden object is impregnated along the whole of its length and right through it.

As wood preservative fluorine compositions or borate compositions are used the latter of which are preferred, and as hygroscopic liquid a glycol formula is used. The wood preservative in solid phase is preferably a fused body of disodium metaborate or boron oxide in the shape of a cylindrical body. As a liquid impregnating agent disodium tetraoctaborate dissolved in monoethylene glycol is preferably used.

A synergistic effect in respect of the spreading of the wood preservative in the relatively dry wood is achieved with the wood preservative dissolved in the hygroscopic liquid. The synergistic effect shows itself in the fact that the wood preservative spreads at a great speed in the relatively dry wood. The reason of this is not fully understood but applicant believes that the hygroscopic liquid absorbs the moisture existant in the wood (possibly also moisture from the surroundings). Accordingly, the moisture ratio of the wood increases at these places and the increased moisture ratio assists in the further spreading of the wood preservative through diffusion. Besides, the hygroscopic liquid spreads in the said wood with the increased moisture ratio and functions as a carrier for the wood preservative so as thereby to assist in further spreading the wood preservative in the wood.

The body of fused biocide composition is dissolved by the moisture ratio of which exceeds 25 to 30% and spreads through diffusion to areas within the wood volume the moisture ratio of which is less than 25% where the dissolved impregnation agent remains and kills established fungus and possible insect attacks.

Certain fungus living in wood has the capacity of spreading by itself transporting the necessary water in its mycelium, whereby wood drier than 25% can be infected and broken down.

By the present invention it is achieved that a hygroscopic and highly viscous liquid, deposited within the volume of wood, remains in the volume of wood which, concealed, may have broken-down, loosened timber and where dry zones have arisen but where remaining fungus mycelium which may be activated by remoistening is killed.

Besides, the advantage is achieved that the highly viscous wood preservative spreads further into the sound wood which surrounds the affected wood.

In the surrounding sound wood the wood preservative serves as a preventive protection against insect and fungus attack.

By the invention it is accordingly achieved that in dry zones of the wood there occurs an impregnation which prevents attack by insects and fungus, while in relatively moist zones the impregnation is curing, i.e. that established fungus and insect attack is killed otherwise the impregnation constitutes a preventive protection in moist zones.

The depots are placed at intermittent distances from each other along the wooden structure so that a volume of the wood preservative in the solid phase will give a lethal dose in a theoretic, spherical volume of wood situated around the depot volume and being at least about 500 times larger than the volume of the wood preservative and so that a volume of the wood preservative in the liquid phase will give a lethal dose in a theoretic, spherical volume of wood situated around the depot volume and being at least about 100 times larger than the volume of the wood preservative.

Figure 2:
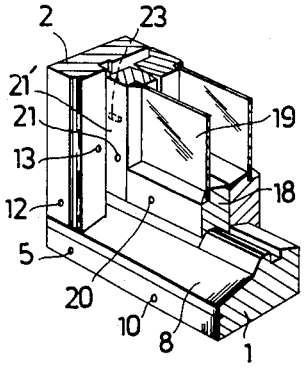
Figure 3:
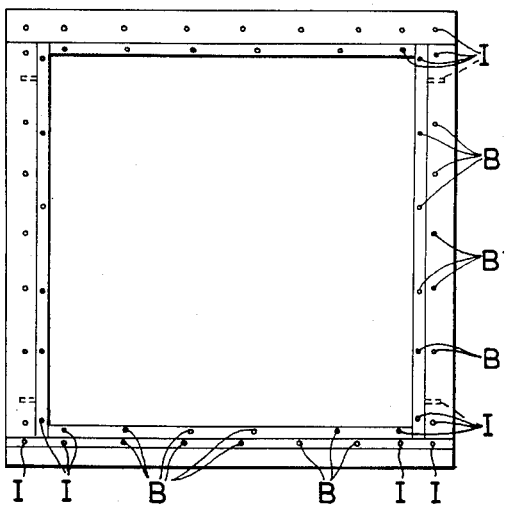

The invention will be described more in detail below in connection with the attached drawings, in which FIG. 1 is a front view of a window casement and the figure shows the fixed placings of the depots according to the invention substantiated by extensive tests, FIG. 2 is a perspective view of a corner portion of a window casement and a window frame and the figure shows more closely details of the location of the depots fixed according to the invention, FIG. 3 is a view similar to FIG. 1 showing the location of the depots according to another embodiment of the invention, FIG 4 is a view similar to FIG. 1 showing the location of the depots in the case of a 4-pane window.

Figure 7:
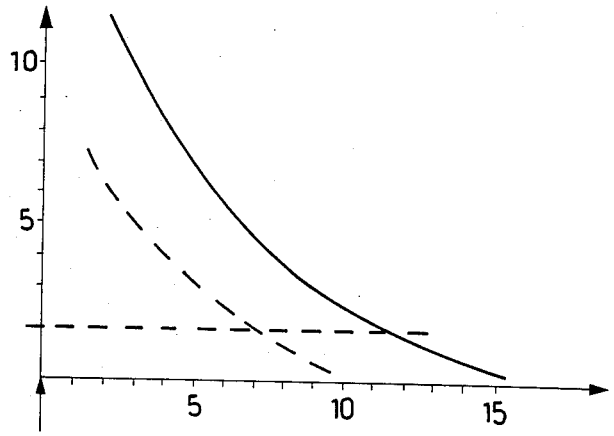
Figure 8:
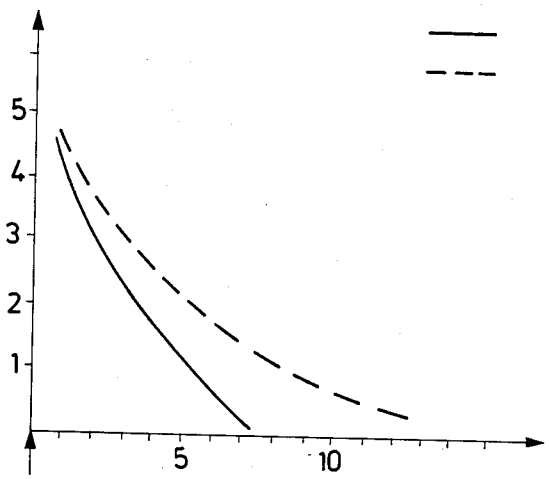
Figure 9:
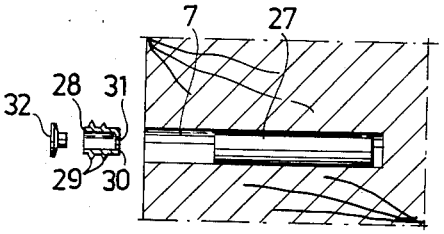

FIG. 5 is a diagram showing the moisture ratio at different distances from a depot of wood preservative dissolved in a hygroscopic liquid, FIG. 6 is a graph which shows the moisture ratio at different distances from a depot in which a fused body of wood preservative has been inserted, FIG. 7 is a diagram which shows the content of wood preservative at different distances from a depot in which there has been placed a wood preservative in fused form, FIG. 8 is a graph similar to FIG. 7 plotted for a depot located in new wood and containing wood preservative dissolved in a hygroscopic liquid and FIG. 9 is a sectional view of a depot and closing means for the latter.

FIG. 1 shows a plane view of a window casement which has been impregnated in accordance with a first embodiment of the invention. The window casement includes a casement sill member 1, side members 2 and 3, respectively, and a casement top member 4. According to this embodiment of the invention the window casement is impregnated only up to a height of about 40 cm which in the normal case will give perfect impregnation. The casement sill member 1 is impregnated in the following way: a first depot or reservoir 5 is placed 3 to 8, preferably 5 to 8 cm, inward from the left-hand end surface, as seen in the figure, of the casement sill member. The exact placing of this depot is dependent on the size of the pin, marked with dashed lines 6, of the casement side member 2. This pin 6 is received in a corresponding recess, not shown, in the casement sill member 1. The exact placing of the depot 5 is chosen so that it lies to the right of the pin 6. The depot consists of a bore 7 (see FIG. 9) filled with wood preservative of a first kind, in the case fused disodium octaborate in the shape of a cylinder. The cylinder contains at least 3 grams of boric acid per cubic centimeter. The bore is directed substantially at right angles to the plane of the window pane not shown. Preferably, the bore runs parallel to the exterior long bevel 8 (compare FIG. 2) of the casement sill member.

A second depot 9 is then placed at the opposite end of the casement sill member 1 while observing the above rules. The depot is filled with the wood preservative of the first kind, marked with I in the drawing. A third depot is then placed 10 to 15 cm beyond the depot 5 and a fourth depot 11 is placed 10 to 15 cm beyond the depot 9. The depots 10 and 11 have the same orientation as the earlier depots and are also filled with the same wood preservative of the first kind. The remaining sections of the casement sill member are then divided up into regular stretches the length of which is 15 to 25 cm and at the dividing points additional depots are placed each of which has the same orientation as the depots 5 to 11 earlier mentioned but which are now filled with a wood preservative of the second kind, namely disodium octaborate dissolved in monoethylene glycol. 1.8 $cm^3$ of the depot contents contains at least 0.3 g boric acid, preferably 1.8 $cm^3$. The wood preservative of the second kind is sold in Sweden under the name of Boracol-40. In the drawing these depots are marked with B. The wood preservative of the first kind is sold in Sweden under the name of IMPEL. In the drawing these depots are marked with I.

Each casement side member 2, 3 is impregnated in the same way and therefore only impregnation of the left-hand casement side member 2 is described below. A first depot 12 filled with the wood preservative of the first kind is placed at a distance of 2 to 4 cm above the connection with the casement sill member 1. The depot is placed at substantially right angles to the plane of the window pane not shown. A second depot 13 filled with wood preservative of the second kind is then placed 10 to 15 cm above the first depot 12 in the casement side member. The depot is placed parallel to the plane of the window pane not shown. A further number of depots oriented in the same way as the depot 12 are then placed above the depot 13 at a regular mutual distance of from about 15 cm to about 25 cm. These additional depots not shown in FIG. 1 are filled with Boracol-40. In the normal case it is sufficient to impregnate up to a height of about 40 cm of each casement side member 2, 3.

If the window has a post 14 which has been marked with dashed lines in FIG. 1 the impregnation described in connection with the casement sill member is modified by the measure that after the placing of the depot 11 two bores 15, 16 are made on each side of the pin normally found in the post and located in a corresponding recess in the casement sill member. The bores 15 and 16 are accordingly placed in association with the end surfaces of said recess where the risk of injuries by moisture is great. To avoid shadow effect it is suitable to arrange a depot/bore on each side of the pin. The bores 15, 16 are then filled with wood preservative of the first kind. The two remaining sections of the casement sill member 1 are then divided up in the way earlier described and as will be seen from FIG. 1 there will be only 3 depots which are filled with wood preservative of the second kind, since the spacing of the depots 11 and 16 is less than about 15 cm.

FIG. 2 shows a detail of a corner joint in connection with a window. The window has an exterior window frame 18 and an exterior window pane 19. The sill member of the exterior window frame 18 is impregnated in the following way: a first depot 20 filled with wood preservative of the first kind is placed 1 to 2 cm from the joining with the side member 21' of the window frame. A corresponding depot is placed at the other end, not shown, of the sill member. The remaining length between the two lastmentioned depots is divided up into regular spaces which are from about 15 to 30 cm and at the dividing points depots are placed which are filled with wood preservative of the second kind. All the depots in the sill member are placed at right angles to the plane of the window pane 19 (or are placed parallel to the plane of the pane and are applied from below). Each side member of the window frame 18 is impregnated in the same way and therefore only the impregnation of the left-hand side member shown in FIG. 2 is described. In this a first depot 21 with wood preservative of the first kind is placed approximately on a level with the top surface of the sill member of the window frame. The depot 21 stands at right angles to the plane of the window pane (or, if the dimension of the frame side member permits, can be oriented parallel to the plane of the window pane). A second depot 23 is then placed 10 to 15 cm above the first depot 21 and is directed parallel to the plane of the window pane 19. This depot is shown only diagrammatically in FIG. 2. It is seen that in the practising of the invention the window is opened and thereupon a hole is bored in the side member towards the left-hand surface of the casement side member 2. Then further depots are placed at a mutual distance of about 15 to about 30 cm from each other above the said second depot 23 up to a height of about 40 cm.

FIG. 3 shows another embodiment of the method according to the invention, the window having been impregnated all around which is necessary under certain circumstances, for example if the window is seriously decayed. The location of the depots at the top of the window is reversed in relation to that at the bottom of the window and therefore need not be described more closely. The locations are indicated diagrammatically in the figure and I designates wood preservative of the first kind while B designates wood preservative of the second kind. FIG. 4 shows a 4-pane window, i.e. a window which has four window pane units capable of being opened. The window frames not shown are impregnated in the same way as the window frame according to the FIGS. 2 and 3 while the location of the depots in the centre post 24 and the transverse posts 25, 26 is seen in the figure. The basic principle is that a depot of wood preservative of the first kind is placed in close association with an end surface which is exposed to moisture. Further away from such an end surface depots may be placed which are filled with wood preservative of the second kind.

FIG. 5 shows the effect of the wood preservative in increasing the moisture ratio. In a long piece of wood the moisture ratio of which initially was about 10% depots filled with wood preservative of the second kind were placed. After about 4.5 months the piece of wood was sawn up into slabs parallel to the depot and the moisture ratio was measured in the various wooden slabs. As will be seen from the graph the moisture ratio has risen to about 18% and thereabove in areas within about 12 cm from the depot. A corresponding graph of moisture ratio (FIG. 6) was plotted for depots with wood preservative of the first kind. Here the wood originally had a moisture ratio of about 30%. As in the previous case the wood in this case was new. From the graph it is seen that the moisture ratio had risen to about 50% within an area of 8 cm around the depot after about 4.5 months.

FIG. 7 is a graph which shows the spreading of boric acid from a depot of wood preservative of the first kind placed in a window which is installed in a building face. The depot is supposed to be located in origo and the abscissa shows the distance in cm from the depot while the ordinate shows the number of kilograms of boric acid per cubic meter absorbed by the wood. The moisture ratio at the depositing of the wood preservative was initially greater than 25%. The dashed graph shows the amount absorbed after about 3.5 months and the full line graph shows the corresponding amount after 9 months. The retarding dose for the growth of fungus is, for the wood preservative used, converted to the equivalent amount of boric acid, 1.5 kg boric acid per cubic meter. The lethal dose is 6 kg per cubic meter. From the figure it is seen that after 9 months a retarding dose is found at a distance of up to 12 cm from the depot while a lethal dose occurs up to a distance of 6 cm from the depot.

FIG. 8 is two graphs similar to FIG. 7, one of which, in full line, shows the spreading of boric acid from a depot of wood preservative of the second kind placed in dry wood (moisture ratio 22%) and the other of which (the one in dashed line) shows the corresponding spreading from a depot of wood preservative of the second kind placed in raw wood (moisture ratio 50%). As will be seen the retarding dose is found at the distances 4.5 and 6.5 cm, respectively, out from the respective depot after a time of 2.5 months.

Tests carried out by Sveriges Lantbruksuniversitet, The Institution of Wood Technology, show that in the case of using borate formulas as a fungicide the retarding dose varies for different fungi between 0.8 and 1.2 kg boric acid equivalent/cubic meter of wood. As a qualified retarding dose of boric acid absorption of 1.5 kg boric acid equivalents/cubic meter of wood is recommended and this dose has to be reached within 9 months from the deposition of the preservative. As a relatively quick-acting lethal dose the absorption of 6 kg boric acid equivalent/cubic meter of wood is recommended. As a slow-acting lethal dose absorption of 2 to 3 kg boric acid/cubic meter is recommended which kills fungi. A cylinder of fused boron octaborate with the diameter 8.5 mm and the length 10 mm has the volume 0.57 cubic centimeter and contains 1.71 g boric acid which theoretically is sufficient to impregnate 285 cubic centrimeters of wood with a lethal dose. From this it can accordingly be established that a cubic centrimeter of the fused cartridge with a lethal dose theoretically can impregnate 500 cubic centrimeter of wood. The corresponding figure for a retarding dose is 2000 cubic centimeter of wood. One cubic centimeter Boracol 40 contains 0.575 g boric acid which theoretically is sufficient to impregnate about 100 cubic centrimeters of wood with a lethal dose. The corresponding figure for impregnating with a retarding dose is about 400 cubic centimeters of wood.

Table 1 shows the maximum spreading of boric acid of the first kind and the second kind, respectively, in sound wood analyzed with a colour reagent. The figures stated refer to spreading from one side of the depot. The total spreading consequently is double as much. The spreading was measured after a period of

| | | | |
|---|---|---|---|
| 2 months | | | |
| Impel | Spreading 1 cm | U = 22% | (1 test) |
| Boracol | Spreading 7 cm | U = 20% | (1 test) |
| Impel | Spreading 11 to 13 cm | U = 44% | (1 test) |
| Boracol | 15 to 17 cm | U = 50% | (1 test) |
| and 4 months | | | |
| Impel | Spreading 1 cm | >U = 23% | (4 tests) |
| Boracol | 11 cm | >U = 23% | (4 tests) |
| Impel | Spreading >20 cm in sapwood, 3 to 11 in heartwood | U = >40% | (4 tests) |
| Boracol | >20 cm in sapwood, 9 to 13 in heartwood | U = >40% | (4 tests) |

The table shows that wood preservative of the first kind spreads very badly in relatively dry wood while it spreads far, more than 11 cm, in relatively moist wood. In sapwood it spreads more than 20 cm if the moisture ratio of the wood is greater than 40%. The table also shows that wood preservative of the second kind spreads far in relatively dry wood, more exactly more than 11 cm within 4 months.

FIG. 9, in the end, shows a section of a depot in the form of a bore 7 in which a cylinder 27 of fused disodium octaborate is inserted. The depot is closed with a cylindrical sleeve 28 having annular skirts or barbs 29 projecting from the wall and made integral with the sleeve. The sleeve has a bottom wall 30 which is made integral with the rest of the sleeve. Centrally in the said bottom there is made a through hole 31. By means of a solid lid 32 the open end of the sleeve may be closed.

The working procedure in impregnating a window is preferably the following: first bores 7 are bored at the places of the depots as above indicated. In the depots to be filled with wood preservative of the first kind the solid cylinders 27 are inserted. Then sleeves 28 are inserted into all the holes bored, and in the bores to be filled with wood preservative of the second kind the wood preservative is introduced for example through a hose or a thick cannula which is inserted in the sleeve 28 through the opening 31. The prescribed number of cubic centimeters of the liquid phase is dosed. All the sleeves 28 are then each closed by a lid 32. The liquid in the depots which are filled with wood preservative of the second kind disappears gradually out into the wood and no further refilling of these holes is of current interest since the amount introduced is intended to give the dose which is needed to establish a preventive protection against fungus growth in the relatively dry sections of the wooden piece. In the bores in which wood preservative of the first kind has been introduced the cylinders remain there during a considerable time, of the order of tens of years, and the cylinders are dissolved and spread the boric acid when the moisture ratio in the surrounding wood exceeds about 30%. By removing the lid 32 and inserting a stick or the like through the hole 31 serving as an inspection opening it may be established if the cylinder 27 remains there or not. Depots filled with such cylinders may possibly need to be renewed after the said time by depositing a new cylinder.

The embodiments of the invention described above may be modified and varied in many different ways within the scope of the basic idea of the invention.

I claim:

1. A method of impregnating a wooden structure by diffusion of boric acid, said wooden structure of the type including a long wooden object along the length of which a moisture ratio varies, said method comprising the steps of:

drilling bores along the length of said wooden structure at intermittent distances from each other;

inserting in selected ones of said bores disodium octaborate in the form of a solid fused body, whereby said disodium octaborate dissolves under the influence of moisture in said wood, to react and form boric acid, which diffuses into said wood;

inserting in remaining ones of said bores disodium octaborate dissolved in a hygroscopic liquid, whereby said disodium octaborate migrates together with said hygroscopic liquid into said wood, and reacts with water bound in cellulose to form boric acid;

said steps of inserting being further characterized by selecting a number of bores with fused bodies relative to the number of bores with liquid, such that the total amount of boric acid formed constitutes a fungus inhibitory dose and being substantially a fungus lethal dose for a volume of wood in said wooden structure;

said step of drilling said bores being further characterized by the step of:

selecting the intermittent distances between bores such that said boric acid penetrates said entire wooden structure, and sealing said bores after the insertion of said boric acid.

2. A method according to claim 1, characterized in that the hygroscopic liquid is a glycol composition.

3. A method according to claim 2, characterized in that said bores are separated by intermittent distances such that said boric acid released from said solid fused body of disodium octaborate inserted in one of said bores will impregnate a wood volume which is at least 2000 times the volume of said body, and such that said disodium octaborate dissolved in said hygroscopic liquid will release boric acid in an amount that will impregnate a wood volume which is at least 400 times the volume of said bore in which it is inserted.

4. A method of diffusion impregnation according to claim 3, said wooden structure including a sill, characterized by the steps of placing a solid fused body of disodium octaborate in a bore about 3 to 8 cm inward from one end surface of said sill, placing a second solid fused body in a bore at a corresponding distance from an opposite end surface of said sill, placing a third solid fused body in a bore at a distance of about 10 to 30 cm from the first bore, placing a fourth solid fused body in a bore at a distance of about 10 to 30 cm from said second bore, and placing additional portions of disodium octaborate dissolved in hygroscopic liquid in bores at predetermined intervals between said solid fused bodies in said third and fourth bores, said predetermined intervals being about 15 to 25 cm, and further characterized by the step of sealing said bores.

5. A method of diffusion impregnation according to claim 4, wherein there is at least one mullion extending vertically from said sill, characterized by the step of placing a solid fused body of disodium octaborate in a bore on either side of a pin of the mullion projecting into said sill.

6. A method of diffusion impregnation according to claim 4, the wooden structure including a jamb, characterized by the step of placing a solid fused body of disodium octaborate in a first bore about 3 cm above a joint between said jamb and said sill, placing an amount of disodium octaborate dissolved in said hygroscopic liquid in a second bore 10 to 15 cm above said first bore, and placing additional amounts of disodium octaborate dissolved in said hygroscopic liquid 10 to 20 cm above said second bore up to a height of about 40 cm above said sill.

7. A method of diffusion impregnation according to claim 6, wherein said jamb is impregnated along its length, characterized by the steps of drilling a first bore about 3 cm above said joint, drilling a second bore 10 to 15 cm above said first, bore drilling a third bore about 3 cm below a joint existing between a window frame head and said jamb, drilling a fourth bore about 20 to 30 cm below the third bore, drilling additional bores at predetermined intervals to each other and to said second and fourth bores, said predetermined interval being about 15 to 30 cm, filling said first and third bores with solid, fused bodies of disodium octaborate, and filling said additional bores with an amount of disodium octaborate dissolved in said hygroscopic liquid.

8. A method of diffusion impregnation according to claim 7, characterized by the step of filling said second and fourth bores with solid, fused bodies of disodium octaborate.

9. A method of diffusion impregnation according to claim 6, said wooden structure including a mullion, characterized by the step of impregnating said mullion in the same manner as said jamb.

10. A method of diffusion impregnation of a wooden structure including a casement having a sash with top and bottom rails and two stiles, characterized by the steps of placing a solid, fused body of disodium octaborate in a bore 1 to 2 cm from either end of said bottom rail of said sash, and placing at either end of either stile an amount of disodium octaborate dissolved in hygroscopic liquid in a bore in alignment with the upper edge of said bottom rail of said sash and the lower edge of said top rail of said sash.

11. A method of diffusion impregnation according to claim 10, further characterized by the step of placing a solid, fused body of disodium octaborate in a bore 1 to 2 cm from either end of said top rail of said sash.

* * * * *